US006795674B2

(12) United States Patent
Endoh et al.

(10) Patent No.: US 6,795,674 B2
(45) Date of Patent: Sep. 21, 2004

(54) DEVELOPING DEVICE FOR AN IMAGE FORMING APPARATUS

(75) Inventors: Shuuichi Endoh, Kanagawa (JP); Osamu Endou, Kanagawa (JP); Yoshihiro Abe, Chiba (JP); Masahide Harada, Tokyo (JP); Nobuhiko Umezawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/679,401

(22) Filed: Oct. 7, 2003

(65) Prior Publication Data

US 2004/0071482 A1 Apr. 15, 2004

Related U.S. Application Data

(63) Continuation of application No. 09/715,126, filed on Nov. 20, 2000, now Pat. No. 6,643,486.

(30) Foreign Application Priority Data

Nov. 19, 1999 (JP) ..... 11-329452

(51) Int. Cl.[7] ..... G03G 15/08
(52) U.S. Cl. ..... 399/284; 399/286
(58) Field of Search ..... 399/252, 274, 399/284, 286

(56) References Cited

U.S. PATENT DOCUMENTS 5,057,871 A 10/1991 Hirose et al.
5,177,537 A 1/1993 Okano et al.

(List continued on next page.)

FOREIGN PATENT DOCUMENTS

JP 8-227224 9/1996
JP 9-319208 12/1997
JP 10-10863 1/1998
JP 11-125931 6/1999
JP 7-295363 11/1999

OTHER PUBLICATIONS

Patent Abstract of Japan, Publication No. 10 104945, Publication Date Apr. 24, 1998 Copyright 1998, JPO.

Patent Abstract of Japan, Publication No. 60 103372, Publication Date Jun. 7, 1985 Copyright 1985, JPO & Japio.

Patent Abstract of Japan, Publication No. 60 103373, Publication Date Jun. 7, 1985 Copyright 1985, JPO & Japio.

U.S. patent application Ser. No. 09/875,034, Endoh et al., filed date Jun. 07, 2001.

U.S. patent application Ser. No. 10/679,401, Endoh et al., filed date Oct. 07, 2003.

*Primary Examiner*—Hoan Tran
(74) *Attorney, Agent, or Firm*—Oblon, Spivak, McClelland, Maier & Neustadt, P.C.

(57) ABSTRACT

A developing device for an image forming apparatus of the present invention includes an image carrier performing endless movement while carrying a developer in the form of a layer thereon, and a regulating member for regulating the thickness of the layer. Toner stored in the developing device is covered with an additive whose particle size is less than 2 μm. The regulating member is implemented as a doctor roller having a surface roughness Rz equal to or greater than the above particle size, but smaller than 2 μm. The doctor roller is pressed against a developing roller or developer carrier by a preselected pressure, forming a nip for development. The developing device reduces irregular development ascribable to impurities caught at a regulating position assigned to the doctor roller more than a conventional developing device using a doctor blade as a regulating member. In addition, the developing device obviates irregular development in the form of fine stripes ascribable to stripe-like irregularities formed in the developer layer existing on the developing roller.

32 Claims, 9 Drawing Sheets

U.S. PATENT DOCUMENTS 5,489,747 A 2/1996 Takenaka et al.
5,552,870 A 9/1996 Murakami et al.
5,617,191 A 4/1997 Murakami et al.
5,625,438 A 4/1997 Sugiyama et al.
5,625,440 A 4/1997 Matsumae et al.
5,625,441 A 4/1997 Sugiyama et al.
5,666,625 A 9/1997 Komatsubara et al.
5,689,782 A 11/1997 Murakami et al.
5,689,784 A 11/1997 Shin et al.
5,697,026 A 12/1997 Matsumae et al.
5,708,942 A 1/1998 Sugiyama et al.
5,845,183 A 12/1998 Sugiyama et al.
5,879,752 A 3/1999 Murakami et al.
5,895,150 A 4/1999 Watabe et al.
5,937,253 A 8/1999 Shimazaki et al.
5,955,228 A 9/1999 Sakai et al.
6,033,818 A 3/2000 Sugiyama et al.
6,242,147 B1 6/2001 Anno et al.
6,456,813 B1 * 9/2002 Sato ..... 399/284
2002/0025199 A1 * 2/2002 Hibino ..... 399/267

* cited by examiner

*Fig. 3*

| SAMPLE NO. | DEVELOPING ROLLER | | | | DOCTOR ROLLER | | | | |
|---|---|---|---|---|---|---|---|---|---|
| | ASCAR C HARDNESS (Deg.) | CORE | COVERING MATERIAL | | ASCAR C HARDNESS (Deg.) | CORE | COVERING MATERIAL | (0.3≦Rz<2.0) | |
| | | MATERIAL | MATERIAL | COVERING METHOD | | MATERIAL | MATERIAL | COVERING METHOD | THICKNESS (μm) |
| (1) | 52 | URETHANE RUBBER | FLUORO-CARBON RESIN | COATING | 56 | URETHANE RUBBER | NYLON | TUBE | 50 |
| (2) | 52 | URETHANE RUBBER | URETHANE RESIN | COATING | 56 | URETHANE RUBBER | ETFE | TUBE | 50 |
| (3) | 52 | URETHANE RUBBER | SILICON RUBBER | COATING | 56 | URETHANE RUBBER | PI | TUBE | 50 |
| (4) | 70 | URETHANE RUBBER | NYLON | TUBE | 56 | URETHANE RUBBER | ETFE | TUBE | 50 |
| (5) | 52 | URETHANE RUBBER | URETHANE RESIN | COATING | 56 | URETHANE RUBBER | ETFE | TUBE | 50 |
| (6) | ABOUT 100 | ALUMINUM | FLUORO-CARBON RESIN | COATING | 56 | URETHANE RUBBER | NYLON | TUBE | 50 |
| (7) | ABOUT 100 | ALUMINUM | PHENOL RESIN | COATING | 56 | URETHANE RUBBER | NYLON | TUBE | 50 |
| (8) | ABOUT 100 | ALUMINUM | PA RESIN | COATING | 56 | URETHANE RUBBER | NYLON | TUBE | 50 |
| (9) | ABOUT 100 | ALUMINUM | URETHANE RESIN | COATING | 56 | URETHANE RUBBER | NYLON | TUBE | 50 |

FIG.4
FIG.4A
FIG.4B

Fig. 4A

| SAMPLE NO. | DEVELOPING ROLLER | | DOCTOR ROLLER | | | | | |
|---|---|---|---|---|---|---|---|---|
| | | | ASCAR C HARDNESS (Deg.) | CORE | COVERING MATERIAL | | | |
| | MATERIAL | VICKERS HARDNESS (HV) | | MATERIAL | SURFACE ROUGHNESS R [μm] | MATERIAL | COVERING METHOD | THICKNESS (μm) |
| (10) | ALUMINUM | 80 | 52 | POLY-URETHANE RUBBER | $0.3 \leq R_z < 2.0$ | NYLON | TUBE | 50 |
| (11) | ALUMINUM | 80 | 60 | EPDM | $0.3 \leq R_z < 2.0$ | NYLON | TUBE | 50 |
| (12) | ALUMINUM | 80 | 45 | SILICON RUBBER | $0.3 \leq R_z < 2.0$ | NYLON | TUBE | 50 |
| (13) | ALUMINUM | 80 | 55 | NBR | $0.3 \leq R_z < 2.0$ | NYLON | TUBE | 50 |
| (14) | ALUMINUM | 80 | 60 | EPICHLORO-HYDRIN RUBBER | $0.3 \leq R_z < 2.0$ | NYLON | TUBE | 50 |
| (15) | ALUMINUM | 80 | 40 | BR | $0.3 \leq R_z < 2.0$ | NYLON | TUBE | 50 |
| (16) | ALUMINUM | 80 | 52 | URETHANE RUBBER | $0.3 \leq R_z < 2.0$ | NYLON | COATING | |
| (17) | ALUMINUM | 80 | 52 | URETHANE RUBBER | $0.3 \leq R_z < 2.0$ | FLUORO-CARBON RESIN | COATING | |
| (18) | ALUMINUM | 80 | 52 | URETHANE RUBBER | $0.3 \leq R_z < 2.0$ | SILICONE RESIN | COATING | |
| (19) | ALUMINUM | 80 | 52 | URETHANE RUBBER | $0.3 \leq R_z < 2.0$ | URETHANE RESIN | CONTING | |

Fig. 4B

| SAMPLE NO. | DEVELOPING ROLLER | | DOCTOR ROLLER | | | | | |
|---|---|---|---|---|---|---|---|---|
| | | | ASCAR C HARDNESS (Deg.) | CORE | COVERING MATERIAL | | | |
| | MATERIAL | VICKERS HARDNESS (HV) | | MATERIAL | SURFACE ROUGHNESS R [μm] | MATERIAL | COVERING METHOD | THICKNESS (μm) |
| (20) | ALUMINUM | 80 | 52 | URETHANE RUBBER | $0.3 \leq Rz < 2.0$ | ETFE | TUBE | 50 |
| (21) | ALUMINUM | 80 | 52 | URETHANE RUBBER | $0.3 \leq Rz < 2.0$ | PVDF | TUBE | 50 |
| (22) | ALUMINUM | 80 | 52 | URETHANE RUBBER | $0.3 \leq Rz < 2.0$ | PET | TUBE | 50 |
| (23) | ALUMINUM | 80 | 52 | URETHANE RUBBER | $0.3 \leq Rz < 2.0$ | ACRYL-URETHANE RESIN | COATING | |
| (24) | SUS | 270 | 52 | URETHANE RUBBER | $0.3 \leq Rz < 2.0$ | NYLON | TUBE | 50 |
| (25) | ALUMITE-PROCESSED ALUMINUM | 290 | 52 | URETHANE RUBBER | $0.3 \leq Rz < 2.0$ | NYLON | TUBE | 50 |
| (26) | Ni-PLATED ALUMINUM | 400 | 52 | URETHANE RUBBER | $0.3 \leq Rz < 2.0$ | NYLON | TUBE | 50 |
| (27) | Cr-PLATED ALUMINUM | 450 | 52 | URETHANE RUBBER | $0.3 \leq Rz < 2.0$ | NYLON | TUBE | 50 |
| (28) | LOW-TEMP NITROGENATED ALUMINUM | 500~1000 | 52 | URETHANE RUBBER | $0.3 \leq Rz < 2.0$ | NYLON | TUBE | 50 |

Fig. 8

| | MATERIAL | ASCAR C HARDNESS (Deg.) OR TENSILE ELONGATION RATIO (%) | THICKNESS (mm) |
|---|---|---|---|
| CORE | POLYURETHANE RUBBER | 30~90 | |
| | EPDM | 50~90 | |
| | SILICONE RUBBER | 20~90 | |
| | EPICHLOROHYDRIN RUBBER | 40~90 | |
| | NITRIL-BUTADIENE RUBBER | 30~90 | |
| COVERING MATERIAL ($0.3 \leq R_z < 2.0$) | EPDM | 600 | 0.05~1 |
| | CHLOROPRENE RUBBER | 700 | 0.1~2 |
| | CHLOROSULFONATED POLYETHYLENE RUBBER | 650 | 0.03~0.8 |
| | NITRILE RUBBER | 800 | 0.05~3 |
| | URETHANE RUBBER | 550 | 0.05~0.5 |
| | EPICHLOROHYDRIN RUBBER | 400 | 0.1~0.5 |
| | FLUORO RUBBER | 300 | 0.03~0.2 |
| | STYRENE-BUTADIENE RUBBER | 600 | 0.1~1.5 |
| | POLYURETHANE ELASTOMER | 600 | 0.05~1 |
| | POLYESTER ELASTOMER | 550 | 0.05~0.5 |
| | STYRENE-BUTADIENE | 1000 | 0.2~2 |
| | NITRILE-BASED ELASTOMER | 400 | 0.05~0.1 |
| | POLYAMIDE ELASTOMER | 400 | 0.03~0.2 |

*Fig. 9*

| | MATERIAL | ASCAR C HARDNESS (Deg.) OR TENSILE ELONGATION RATIO (%) | THICKNESS ($\mu$m) |
|---|---|---|---|
| CORE | POLYURETHANE RUBBER | 30~91 | |
| | EPDM | 50~90 | |
| | SILICONE RUBBER | 20~90 | |
| | EPICHLOROHYDRIN RUBBER | 40~90 | |
| | NBR | 30~90 | |
| COVERING MATERIAL ($0.3 \leq R_z < 2.0$) | NYLON 6 | 400 | 30~121 |
| | NYLON 66 | 200 | 50~100 |
| | NYLON 11 | 350 | 40~80 |
| | NYLON 12 | 300 | 20~150 |
| | POLYETHYLENE | 450 | 20~150 |
| | POLYPROPYLENE | 500 | 35~150 |
| | POLYVINILIDENE FLUORIDE | 250 | 50~100 |
| | POLYESTER | 300 | 30~80 |

DEVELOPING DEVICE FOR AN IMAGE FORMING APPARATUS

This application is a continuation of 09/715,126, now U.S. Pat. No. 6,643,486.

BACKGROUND OF THE INVENTION

The present invention relates to a copier, facsimile apparatus, printer or similar image forming apparatus. More particularly, the present invention relates to a developing device for an image forming apparatus of the type including a developer carrier, which performs endless movement to convey a developer deposited thereon in the form of a layer, and a regulating member for regulating the thickness of the layer.

In a developing device of the type described, a regulating member is often implemented as a stationary doctor blade contacting or facing a developing roller or similar developer carrier, which performs endless movement. The doctor blade regulates the thickness of a developer deposited on the developer carrier in the form of a layer, so that the developer carrier conveys a preselected amount of developer to a developing position where it faces an image carrier. This successfully stabilizes image density.

The problem with the developing device using the doctor blade is that paper dust and other impurities, as well as deteriorated developer particles, form lumps and are caught in a gap between the developer carrier and the doctor blade. This gap will be referred to as a regulating position hereinafter. The impurities caught at the regulating position form stripe-like grooves in the developer layer deposited on the developer carrier, causing stripe-like irregularities to appear in the resulting image.

To solve the above-described problem, Japanese Patent Laid-Open Publication No. 10-104945, for example, discloses a developing device using a rotatable doctor roller as a regulating member. By rotating the doctor roller while causing the developer carrier to perform endless movement, it is possible to remove the impurities staying at the regulating position and therefore to reduce irregular development. The doctor roller, playing the role of a regulating member, has a surface roughness Rz of 2 $\mu$m to 100 $\mu$m.

As for a developing device, two different types of developing systems are available, i.e., a contact type developing system and a non-contact type developing system. In a contact type developing system, a developer deposited on a developer carrier and an image carrier, which faces the developer carrier, contact each other such that the developer deposits on a latent image formed on the image carrier. In a non-contact type developing system, the developer on the developer carrier is spaced from the image carrier and deposits on the image carrier by flying away from the developer carrier. Generally, the contact type developing system advantageous over the non-contact type developing system in that it enhances the sharpness of an image, i.e., implements high resolution.

We conducted a series of experiments by applying the contact type developing system to the developing device taught in the previously mentioned Laid-Open Publication No. 10-10495. The experiments showed that irregular development occurred in the form of fine stripes. Such irregular development was particularly conspicuous when toner having a relatively small volume mean particle size of 5 $\mu$m to 9 $\mu$m was used as a developer in order to enhance resolution. Although this kind of irregular development was less noticeable than the irregular development ascribable to the impurities, it had critical influence on image quality. Extended researches and experiments showed that the above irregular development was ascribable to the following cause.

When the roller, serving as a regulating member, had a relatively great surface roughness Rz of 2 $\mu$m to 100 $\mu$m, fine irregularities existing on the surface of the roller formed fine stripes on a developer layer. In the non-contact type developing system, such stripes do not noticeably effect the deposition of the developer on a latent image because the developer flies away from the developer carrier. In the contact type development system, however, the stripes formed in the developer layer, which directly contacts the latent image, noticeably effects density and brings about irregular development.

Another problem with the doctor roller or similar movable regulating member is that it brings about irregular development due to shape errors. As for the roller, for example, it is almost impossible to practically obviate shape errors on a production line. In practice, the roller has, e.g., a cross-section slightly different from the expected circular cross-section. As a result, the locus along which the surface of the roller moves is not circular and causes the distance between the surface and the developer carrier and therefore the thickness of the developer layer to vary in accordance with the rotation angle of the roller. This makes the thickness of the developer layer irregular and brings about irregular development. This is also true with a developing device using any other movable regulating member, e.g., one having a semicircular cross-section whose curved surface faces a developer carrier and moves back and forth within the range in which it faces the developer carrier.

Technologies relating to the present invention are disclosed in, e.g., Japanese Patent Laid-Open Publication Nos. 7-295363, 8-227224, 9-319208, 10-10863 and 11-125931.

SUMMARY OF THE INVENTION

It is therefore an object of the present invention to provide a developing device capable of reducing irregular development ascribable to impurities caught at the regulating position, compared to the case wherein a doctor blade is used as a regulating member, and obviating fine stripes ascribable to stripes formed in a developer layer present on an image carrier.

It is another object of the present invention to provide a developing device capable of reducing irregular development ascribable to impurities caught at the regulating position, compared to the case wherein a doctor blade is used as a regulating member, and obviating irregular development ascribable to the shape errors of the regulating member.

In accordance with the present invention, a developing device for an image forming apparatus includes a developer carrier performing endless movement while carrying a developer containing toner and an additive covering the toner thereon, and a regulating member for regulating the thickness of the developer deposited on the developer carrier in the form of a layer. The additive of the developer has a particle size of less than 2 $\mu$m while the regulating member has a surface roughness Rz greater than or equal to the particle size, but smaller than 2 $\mu$m, and performs the endless movement or moves back and forth along a preselected path.

Also, in accordance with the present invention, a developing device for an image forming includes a developer carrier performing endless movement while carrying a developer containing toner and an additive covering the toner thereon, and a regulating member for regulating the thickness of the developer deposited on the developer carrier in the form of a layer. The regulating member has a surface roughness Rz of 1.2 $\mu$m or above, but smaller than 2 $\mu$m, and performs the endless movement or moves back and forth along a preselected path.

Further, in accordance with the present invention, a developing device for an image forming apparatus includes a developer carrier performing endless movement while carrying a developer containing toner and an additive covering the toner thereon, and a regulating member for regulating the thickness of the developer deposited on the developer carrier in the form of a layer. The regulating member includes a surface layer having a tensile elongation ratio of 150% or above and an under layer having an Ascar C hardness of 90 degrees or below and has a surface performing endless movement or moving along a preselected path.

BRIEF DESCRIPTION OF THE DRAWINGS

The above and other objects, features and advantages of the present invention will become more apparent from the following detailed description taken with the accompanying drawings in which:

FIG. 3 is a table listing the results of experiments conducted to determine a relation between the hardness of the doctor roller and that of a developing roller also included in the illustrative embodiment;

FIG. 4 is a table listing the results of experiments conducted to determine the combination of a developing roller and a doctor roller capable of obviating irregular development;

FIGS. 8 and 9 are tables each listing the results of particular experiments conducted to determine a doctor roller capable of obviating irregular development.

DESCRIPTION OF THE PREFERRED EMBODIMENTS

Figure 1:
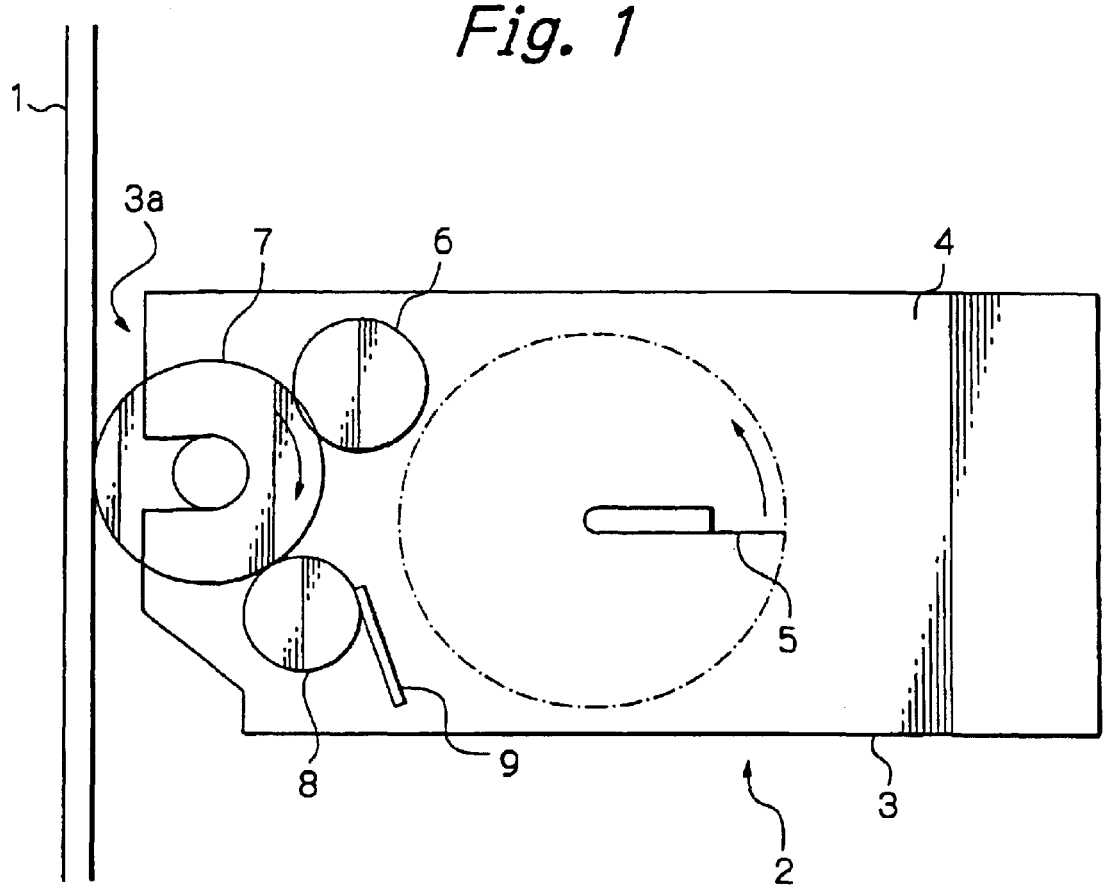
FIG. 1 is a view showing a developing device embodying the present invention together with a photoconductive belt, which is a specific form of an image carrier included in an image forming apparatus.

Referring to FIG. 1 of the drawings, a developing device embodying the present invention is shown. The illustrative embodiment uses a single-ingredient type developer, i.e., toner having a mean particle size of 0.3 $\mu$m to 0.5 $\mu$m and covered with an additive. As shown, the developing device, generally 2, includes a casing 3 formed with an opening 3*a*. A hopper 4, an agitator 5, a toner feed roller 6, a developing roller or developer carrier 7, a doctor roller or regulating member 8 and a blade 9 are accommodated in the casing 3. The developing roller 7 faces a photoconductive belt or image carrier (simply belt hereinafter) 1, which is included in an image forming apparatus, via the opening 3*a*. A latent image is formed on the belt 1 by a conventional electrophotographic process.

The hopper 4 is defined in the right portion of the casing 3, as viewed in FIG. 1, and stores toner, not shown, covered with silica, titanium or similar additive. A drive source, not shown, causes the agitator 5 positioned in the hopper 4 to rotate counterclockwise, as indicated by an arrow in FIG. 1. The agitator 5 in rotation conveys the toner toward the toner feed roller 65 and developing roller 7 while agitating it.

The toner feed roller 6 is implemented by a metallic core or under layer covered with polyurethane, silicone, EPDM, polycarbonate or similar foam material. The toner feed roller 6 contacts the developing roller 7, forming a nip having a preselected width. A drive source, not shown, causes the toner feed roller 6 to rotate in the same direction as or in the opposite direction to the developing roller 7. The toner feed roller 6 feeds the toner conveyed thereto by the agitator 5 to the developing roller 7 while removing the toner left on the roller 7 without being transferred to the belt 1. The toner feed roller 7 and developing roller 6 cooperate to promote the frictional charging of the toner arrived at the nip therebetween.

A drive source, not shown, causes the developing roller 7 to rotate clockwise, as viewed in FIG. 1, at a linear velocity that is 1.1 to 2.0 times as high as the linear velocity of the belt 1. The developing roller 7 sequentially conveys the toner deposited thereon via a regulating position, a developing position and a position where the roller 7 contacts the toner feed roller 6 in this order. A power source, not shown, applies a DC bias for development to the developing roller 7 so as to form an electric field at the developing position between the belt 1 and the roller 7.

The doctor roller 8 is pressed against the developing roller 7 by a preselected pressure at a position downstream of the toner feed roller 6 in the direction of rotation of the roller 7, forming a nip having a preselected width. A drive source, not shown, causes the doctor roller 8 to rotate in the same direction as or the opposite direction to the developing roller 7. The nip between the doctor roller 8 and the developing roller 7 defines the regulating position for regulating the thickness of a toner layer formed on the developing roller 7. The individual toner particle forming the above toner layer frictionally contacts both of the surface of the developing roller 7 and that of the doctor roller 8 when moving through the nip and is charged thereby to a level high enough to exhibit a sufficient developing ability.

The blade 9 contacts the doctor roller 8 for mechanically removing the toner and impurities deposited on the roller 8.

The developing device 2 is positioned such that the toner layer regulated in thickness by the doctor roller 8 contacts the belt 1 at the developing position between the surface of the developing roller 7 and that of the belt 1.

The electric field formed at the developing position exerts an electrostatic force that causes the toner to move from the developing roller 1 toward a latent image formed on the belt 1, but prevents it from moving toward the non-image portion or background of the belt 1. As a result, the toner moves toward the latent image when brought into contact with the belt 1, developing the latent image by the previously stated contact type developing system. The contact type developing system enhances the sharpness of an image more than the non-contact type developing system, as stated earlier. Moreover, because the contact type developing system needs only a DC power source for the application of a bias, it is lower in cost than the non-contact type developing system that needs an AC power source in addition to a DC power source.

Even when paper dust and the lumps of deteriorated toner are caught at the regulating position between the doctor roller 8 and the developing roller 7, they can be forcibly removed only if the doctor roller 8 is caused to rotate. This is successful to reduce irregular development ascribable to the impurities, compared to a developing device using a doctor blade, which cannot forcibly remove such impurities.

The doctor roller 8 may be rotated by some drive source or rotated by the developing roller 7. Also, the rotation of the doctor roller 8 may be effected during development or in the stand-by state of the image forming apparatus. When the doctor roller 8 is rotated during development, there can be obviated the accumulation of frictional heat of the toner attracted by the roller 8 due to, e.g., a mirror force and held stationary on the roller 8 without following the rotation of the developing roller 7. More specifically, the doctor roller 8 in rotation moves the stationary toner away from the regulating position and thereby prevents heat ascribable to friction between the toner and the developing roller 7 from accumulating in the toner. This reduces the adhesion of melted toner to the doctor roller 8 and developing roller 7. In addition, the friction between the toner and the doctor roller 8 promotes the frictional charging of the toner so as to obviate various troubles resulting from short charging.

On the other hand, assume that the doctor roller 8 is rotated in the stand-by state of the image forming apparatus. Then, there can be obviated irregular development ascribable to the oscillation of the developing roller 7 that is, in turn, ascribable to friction between the doctor roller 8 and the developing roller 7.

The doctor roller 8 is pressed against the developing roller 7 by a preselected pressure, as stated previously. In practice, a preselected gap exists between the doctor roller 8 and the developing roller 7 due to the toner intervening therebetween. To sufficiently promote the frictional charging of such toner and to maintain the thickness of the toner layer constant, the above gap should preferably be provided with a size allowing the toner to pass therethrough only in a single layer. However, when the doctor roller 8 has a relatively great surface roughness Rz, the gap between the doctor roller 8 and the developing roller 7 becomes irregular in size and is apt to form fine stripes, or irregularities, on the surface of the toner layer. Such stripes would appear in a developed image also.

In light of the above, we experimentally determined a relation between the surface roughness Rz of the developing roller 8 and the irregular development ascribable to the stripes formed in the surface of the toner layer. For experiments, the developing roller 7 was implemented by an aluminum roller having a Vickers hardness of 80 Hv. The doctor roller 8 included a core formed of urethane rubber and a surface layer formed of urethane resin and having a surface roughness Rz ranging of 0.8 μm to 3 μm. The entire doctor roller 8 had an Ascar C hardness of 52 degrees. The developing device formed 600 dpi (dots per inch), 2 dots/pixel halftone images.

Figure 2:
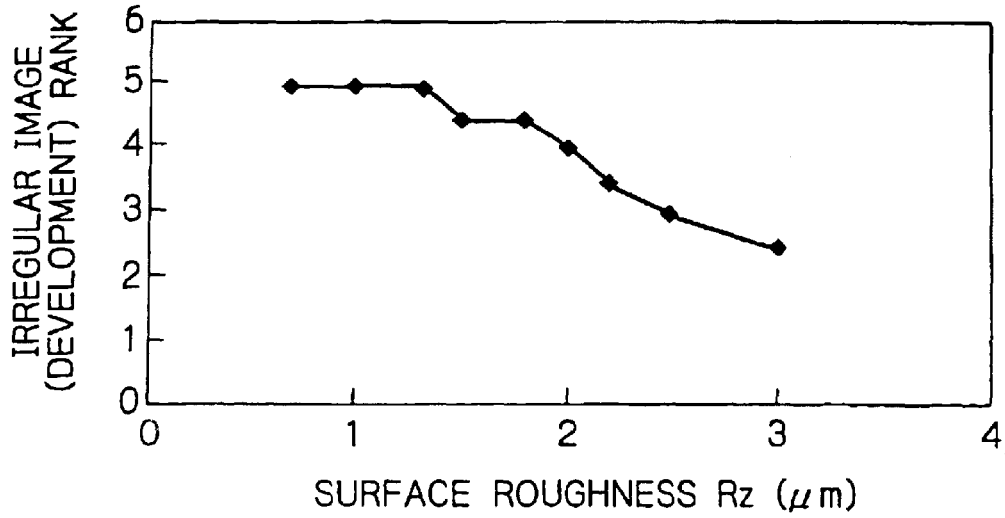
FIG. 2 is a graph showing a relation between the surface roughness Rz of a doctor roller or regulating member included in the illustrative embodiment and irregular development ascribable to stripes formed in a toner layer.

FIG. 2 shows the ranks of irregular development determined by eye. In FIG. 2, irregular development is divided into four ranks; ranks 4 and above are acceptable. Specifically, rank 5 shows that no irregular development was found while rank 4 shows that irregular development was found, but visually not offensive. Rank 3 shows that irregular development was conspicuous. Rank 2 shows that irregular development disturbed the resulting image. Further, rank 1 shows that the resulting image was disturbed too much to surely transfer information.

As FIG. 2 indicates, the surface roughness Rz renders the irregular development ascribable to the stripes visually offensive when it is 2 μm or above, but makes the irregular development acceptable if less than 2 μm. It will also be seen that when the surface roughness Rz is 1.2 μm or below, no significant difference in rank occurs.

Generally, surface roughness Rz close to zero is technically extremely difficult to achieve; bringing it closer to zero results in a higher cost. Further, the additive covering the surfaces of toner particles scratch the surface of the doctor roller 8 with the result that the surface roughness Rz approaches the particle size of the additive as the developing operation is repeated. For example, in the developing device 2 shown in FIG. 1, the additive covering the toner has a mean particles size of 0.3 μm to 0.5 μm. In this case, even if the doctor roller 8 initially has a surface roughness Rz of less than 0.3 μm, the surface roughness Rz sequentially increases up to a range of from about 0.3 μm to about 0.5 μm due to repeated development. Consequently, a difference between the cost required to provide the doctor roller 8 with the surface roughness Rz equivalent to the mean particle size of the additive (0.3 μm to 0.5 μm) and the cost required to provide it with the surface roughness Rz smaller than the mean particle size is wasted. It is therefore necessary to obviate the irregular development ascribable to the irregular thickness of the toner layer while preventing the cost required to machine the surface of the doctor roller 8 from being wasted. For this purpose, the doctor roller 8 should preferably be provided with a surface roughness Rz greater than or equal to the mean particle size of the additive, but below 2 μm. More specifically, in the illustrative embodiment, the surface roughness Rz should preferably be above 0.3 μm, but below 2 μm. More preferably, the surface roughness Rz should be 1.2 m in order to process the surface of the doctor roller 8 at the lowest cost within the range that reduces the irregular development to the most acceptable rank. Stated another way, paying attention only to the obviation of the irregular development, when the surface of the doctor roller 8 is processed to less than 1.2 μm, a difference between the cost required to so process the doctor roller 8 and the cost required to process it to 1.2 μm is wasted. The surface roughness Rz of 1.2 μm successfully saves such a wasteful cost.

It was experimentally found that for a given surface roughness Rz of the doctor roller 8, the undesirable stripes were aggravated as the volume mean particles size of the toner decreased. It follows that to enhance resolution the mean particle size of the toner should preferably be as small as possible. Specifically, the mean particle size should preferably be 5 μm to 9 μm.

When the surface layer of the developing roller 7 was formed of rubber or resin and when the developing roller 7 and doctor roller 8 both were provided with relatively high hardness, the rollers 7 and 8 sometimes oscillated when brought into frictional contact with each other and prevented the toner layer on the roller 7 from having stable thickness. We experimentally determined that to prevent the rollers 7 and 8 from oscillating, there should hold a relation:

$$Hdev+Hdoc \geqq 60 \text{ degrees}$$

where Hdev and Hdoc denote the Ascar C hardness of the roller 7 and that of the roller 8, respectively. FIG. 3 lists various combinations of the rollers 7 and 8 satisfying the above relation and found to produce images free from irregular development by tests.

Presumably, the above relation in hardness is achievable even if the cores and covering materials of the developing roller in Sample Nos. (1) through (9) listed in FIG. 3 are replaced with each other at random, if those of the doctor roller are replaced with each other at random, and if the resulting developing rollers and doctor rollers are suitably combined. In FIG. 3, the term "Roller Core" refers to a core formed on a metallic shaft or similar shaft. In practice, therefore, the developing roller 7 is a laminate made up of a shaft, a core, and a material covering the core.

Errors in the shape of the developing roller 7 and that of the doctor roller 8 is another cause of the irregular thickness of the toner layer formed on the developing roller 7. The irregular thickness ascribable to this cause can be reduced to a certain degree if the rollers 7 and 8 each have relatively low hardness. However, when the developing roller 7 must be relatively hard due to, e.g., a limited developing characteristic, the only way available for obviating the irregular thickness is to control the hardness of the doctor roller 8.

We examined irregularity in the thickness of the toner layer by varying the Ascar C hardness of the surface of the doctor rollers 8 while maintaining the Vickers hardness of the surface of the developing roller 7 above 50 Hv. When the doctor roller 8 had an Ascar C hardness above 80 degrees, it failed to flexibly deform in accordance with shaped errors at the nip between it and the developing roller 7 and brought about the irregular thickness of the toner layer and irregular development. By contrast, the doctor roller 8 flexibly deformed in accordance with the above errors when provided with an Ascar C hardness of 80 degrees or below, because of a linear pressure of 100 N.m to 2,000 N.m acting at the nip where the toner was present. More specifically, the portion of the doctor roller 8 whose locus was closer to the developing roller 7 than the loci of the other portions successfully deformed more than the latter. Also, when the portion of the developing roller 7 whose locus was closer to the doctor roller 8 than the loci of the other portions entered the nip, the portion of the doctor roller 8 faced the above portion of the roller 7 deformed more than the other portions of the roller 8. Because the rollers 7 and 8 so deformed, they successfully maintained the thickness of the toner layer constant at the nip and thereby obviated irregular development ascribable to errors in shape.

FIG. 4 lists various combinations of the developing roller 7 and doctor roller 8 that were found to produce images free from irregular development by tests.

Presumably, the irregular development can be obviated even if the cores and covering materials of the developing roller in Sample Nos. (10) through (28) listed in FIG. 4 are replaced with each other at random, if those of the doctor roller are replaced with each other at random, and if the resulting developing rollers and doctor rollers are suitably combined. Again, in FIG. 4, the developing roller 7 has a three-layer structure in which a roller core is formed on a roller shaft.

As stated above, the developing device 2 reduces irregular development ascribable to impurities caught at the regulating position more than the conventional developing device using a doctor blade, and reduces irregular development ascribable to the stripes. Further, the developing device 2 frees the toner layer from irregular thickness ascribable to the oscillation of the developing roller 7 and doctor roller 8 and therefore irregular development ascribable to irregular thickness. At the same time, the developing device 2 obviates irregular thickness ascribable to the shape errors of the rollers 7 and 8 and therefore irregular development ascribable to irregular thickness. It follows that the developing device obviates short toner charge otherwise brought about by an excessively thick toner layer, and therefore background contamination ascribable to short toner charge.

An alternative embodiment of the present invention will be described hereinafter with reference to FIG. 5. Basically, the alternative embodiment is also practicable with the construction described with reference to FIG. 1. In the figures, identical reference numerals designate identical structural elements. The processing cost increases with a decrease in the surface roughness Rz of the doctor roller 8, as stated earlier. However, when the doctor roller 8 has a section shown in FIG. 5, it can be provided with a relatively small surface roughness Rz, e.g., 0.5 $\mu$m at a relatively low cost.

Figure 5:
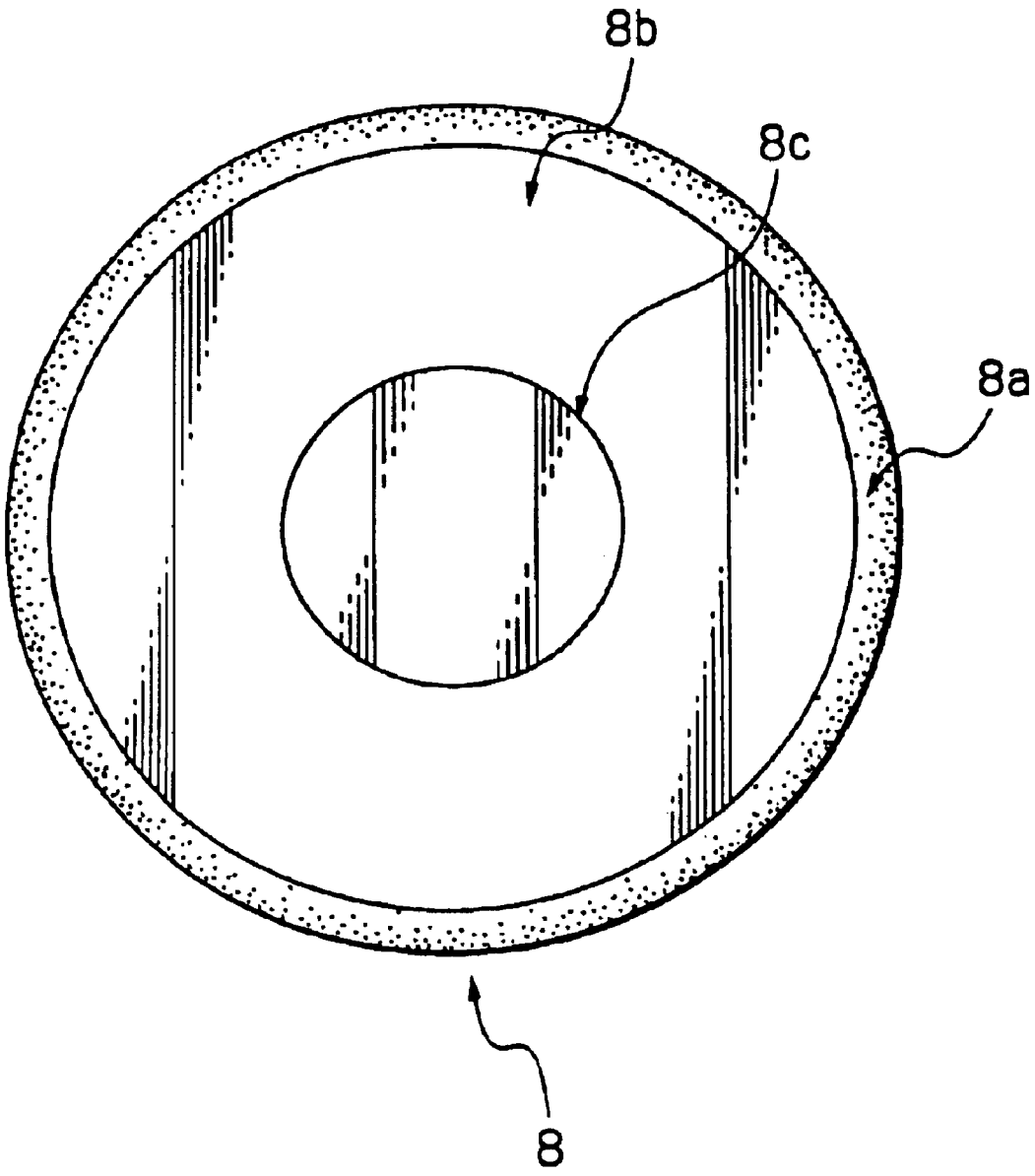
FIG. 5 is a section of a developing roller representative of an alternative embodiment of the present invention.

Specifically, as shown in FIG. 5, the doctor roller 8 is made up of a shaft 8*c* formed of, e.g., metal, a core 8*b*, and a surface layer or covering material 8*a* covering the core 8*b*. The surface layer 8*a* is formed by extrusion molding or centrifugal molding beforehand in such a manner as to have a relatively small surface roughness Rz. The surface layer 8*a* is then attached to a roller constituted by the shaft 8*c* and core 8*b*. The prerequisite with this configuration is that the material of the surface layer 8*a* and that of the core 8*b* be adequately selected. Otherwise, the deformation of the doctor roller 8 at the regulating position (nip in the illustrative embodiment) is apt to be short and bring about irregular development ascribable to the shape errors of the developing roller 7 and doctor roller 8. Particularly, the material of the surface layer 8*a* must be elastic.

Figure 6:
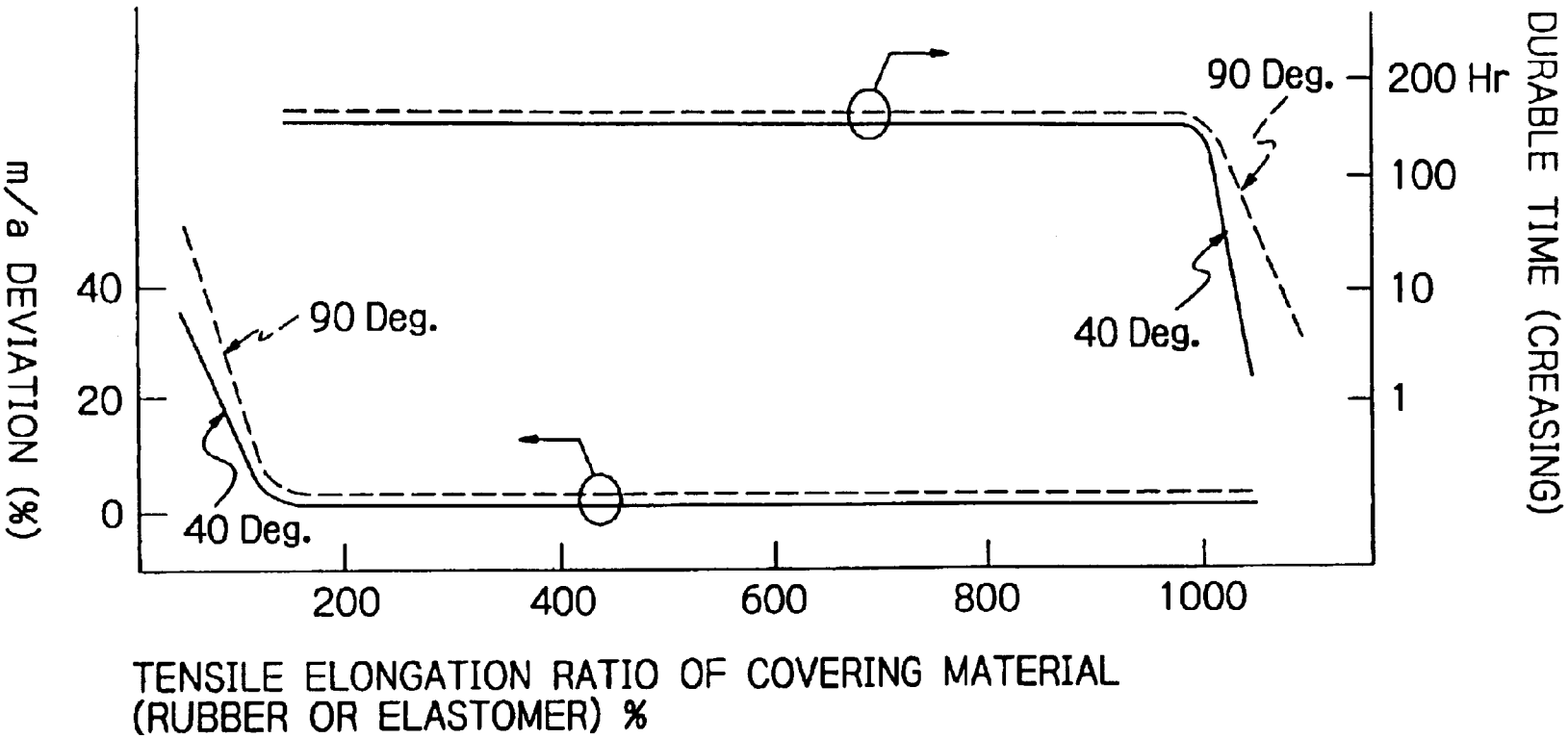
FIG. 6 is a graph showing a relation between the tensile elongation ratio of a covering material (rubber or elastomer resin) included in the illustrative embodiment, the Ascar C hardness of a core or under layer also included in the illustrative embodiment, and the stability of the thickness of a toner layer.
Figure 7:
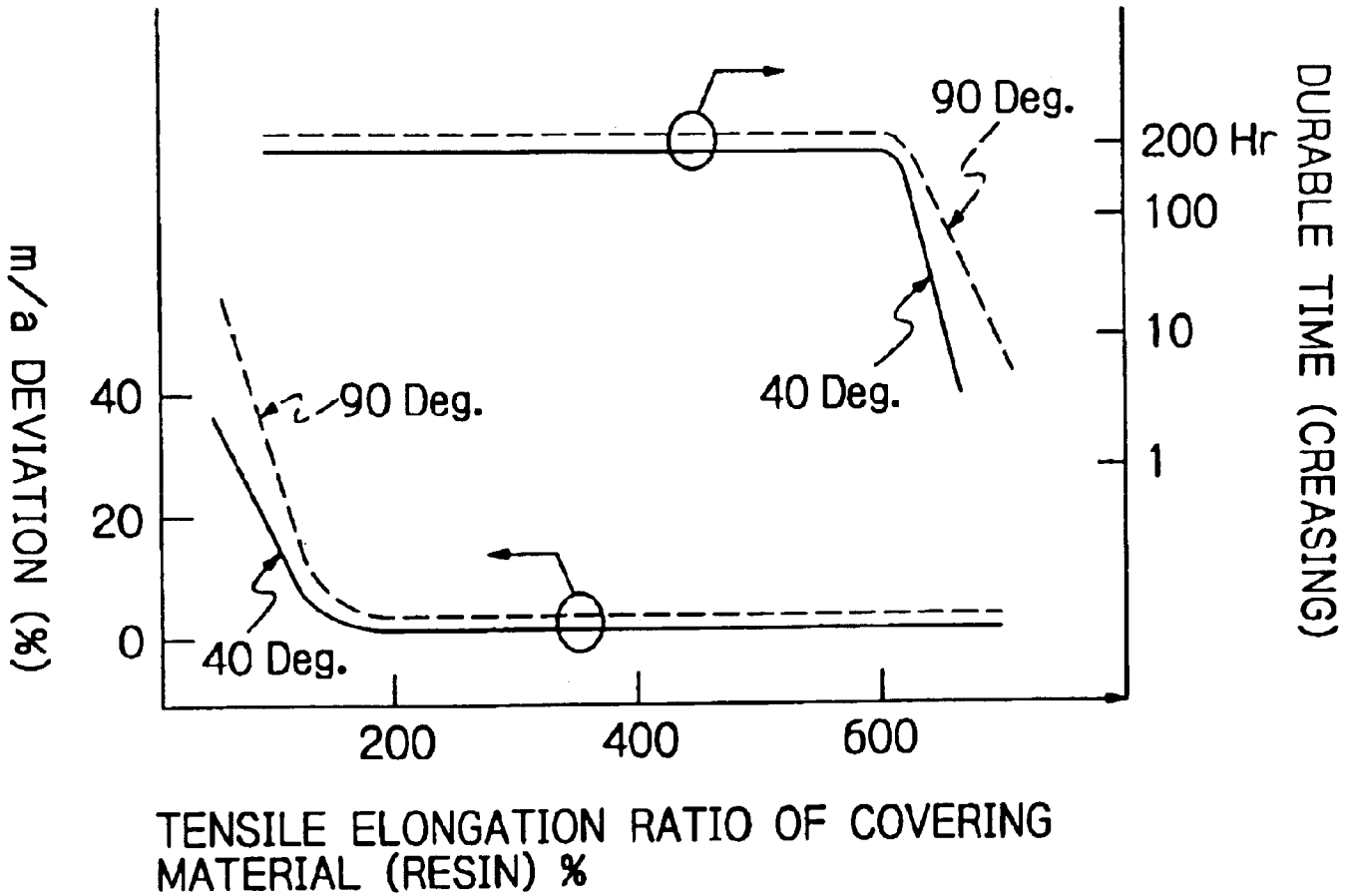
FIG. 7 is a graph similar to FIG. 6 except for the covering.

Generally, an elastic material has some degree of tensile elongation ratio. Paying attention to the tensile elongation ratio of the surface layer 8*a* and the Ascar C hardness of the core 8*b*, we experimentally determined the stability of the thickness of the toner layer formed on the developing roller 7 by using the combinations of various materials. FIGS. 6 and 7 are graphs showing experimental results. In FIGS. 6 and 7, the left ordinate indicates the stability of the thickness in terms of the m/a deviation (%) of the thickness while the right ordinate indicates durable time. The left ordinate applies to two lower curves shown in FIGS. 5 and 6. Among four curves shown in each of FIGS. 6 and 7, two dashed curves indicate the characteristic of the doctor roller 8 whose core 8*b* had an Ascar C hardness of 90 degrees while two solid curves indicate the characteristic of the doctor roller 8 whose core 8*b* had an Ascar C hardness of 40 degrees.

The results shown in FIG. 6 were obtained with the surface layer 8*a* implemented by rubber or elastomer resin. The results shown in FIG. 7 were obtained with the surface layer 8*a* implemented by nylon resin, polyethylene resin, polypropylene resin, polyvinylidene fluoride resin or polyester resin.

As FIGS. 6 and 7 indicate, when the core 8*b* with an Ascar C hardness of 90 degrees or below and the surface layer 8*a* with a tensile elongation ratio of 150% or above are combined, the toner layer formed on the developing roller 7 has a uniform thickness and is free form instability ascribable to shape errors. By contrast, even if the core 8*b* has an Ascar C hardness of 90 degrees, it prevents the doctor roller 8 to flexibility deform at the regulating position when combined with the surface layer 8*a* whose tensile elongation ratio is less than 150%. This renders the thickness of the toner layer unstable due to shape errors.

The surface layer 8*a*, however, tends to crease and reduce the durable time of the doctor roller 8 as the tensile elongation ratio thereof increases. The durable time should preferably be at least 200 hours. As FIG. 6 indicates, when the surface layer 8*a* is implemented by rubber or elastomer resin that does not allow the cover layer 8*a* to easily crease, the surface layer 8*a* does not crease in 200 hours of operation even if its tensile elongation ratio is increased up to 100%. Further, as FIG. 7 indicates, even nylon resin, polyethylene resin, polypropylene resin polyvinylidene fluoride resin or polyester resin, which causes creases to relatively easily appear, protects the surface layer 8*a* from creases in 200 hours of operation if the tensile elongation ratio of the surface layer 8*a* is 600% or less. Therefore, the surface layer 8*a* should preferably be implemented by rubber or elastomer resin having a tensile elongation ratio of 150% to 1,000% or resin having a tensile elongation ratio of 150% to 600%. By attaching such a surface layer 8*a* to the core 8*b* whose Ascar C hardness is 90 degrees or below, it is possible to obviate irregular development ascribable to shape errors and to protect the surface layer 8*a* from creases even in 200 hours of operation.

Experiments, however, showed that when the thickness of the surface layer 8*a* was less than 0.03 mm in FIG. 6 or less than 15 $\mu$m in FIG. 7, the durable time was reduced due to cracks formed in the surface layer 8*a* or the peeling of the layer 8*a*. Also, when the above thickness was greater than 3 mm in FIG. 6 or greater than 150 $\mu$m in FIG. 7, close adhesion between the surface layer 8*a* and the core 8*b* was sharply deteriorated, resulting in unstable contact of the surface layer 8*a* with the developing roller 7. Preferably, therefore, the thickness of the surface layer 8*a* should be between 0.03 mm and 3 mm in FIG. 6 or between 15 μm and 150 μm in FIG. 7. This insures close contact of the surface layer 8*a* and core 8*b* while preventing the durable time from being reduced by the cracking or the peeling of the surface layer 8*a*.

It was experimentally found that materials listed in FIGS. 8 and 9, which satisfied the above-described conditions, successfully protected images from irregular development. Presumably, images free from irregular development are also achievable even if the materials of the core and those of the surface layer each are replaced at random.

The surface layer 8*a* should preferably be seamless because a seam portion would provide the toner layer with a thickness different from the thickness provided by the other portion and would thereby bring about irregular development. In addition, the seam portion would apply a shock to the developing roller 7. To obviate irregular development ascribable to a seam, the doctor roller 8 may be provided with an outside diameter greater than the length of the image forming range of the belt 1. This, however, makes the developing device critically bulky.

The seamless surface layer 8*a* may be implemented as a hollow cylinder produced by extrusion molding or centrifugal molding. It is preferable to provide the cylindrical surface layer 8*a* with an inside diameter smaller than the outside diameter of the core 8*b* and then attach the former to the latter by stretching it. The resulting tension of the surface layer 8*a* enhances close contact of the surface layer 8*a* and core 8*b* and allows a minimum of creasing to occur in the surface layer 8*a*. In addition, the above tension substantially prevents the toner from entering the interface between the surface layer 8*a* and the core 8*b*.

Alternatively, the core 8*b* may be contracted, then covered with the surface layer 8*a*, and then restored. This can be done by, e.g., solid foaming. If desired, the core 8*b* made of polyurethane or silicone may be inserted in the surface layer 8*a* and then caused to foam and expand. Further, the surface layer 8*a* made of nylon or similar resin, which is thermally contractible, may be caused to thermally contract on the core 8*b*.

The tensile strength of the surface layer 8*a*, as measured on the surface of the core 8*b*, is another factor that effects the creasing of the surface layer 8*a*. The tensile strength additionally effects the cracking of the surface layer 8*a*. In light of this, we experimentally determined a relation between the tensile strength of the surface layer 8*a* on the core 8*b* and the creasing or the cracking of the surface layer 8*a*. When the surface layer 8*a* was formed of rubber or elastomer resin and provided with a tensile strength of less than 0.005 G $N/m^2$ where G denotes acceleration, the tensile strength was short and caused the surface layer 8*a* to crease and crack. More specifically, such a surface layer 8*a* endured 10,000 to 20,000 consecutive paper sheets, but failed to closely adhere to the core 8*b*, creased and cracked when more than 30,000 paper sheets were dealt with. It follows that the surface layer 8*a* should preferably be attached to the core 8*b* in such a manner as to have a tensile strength of 0.05 G $N/m^2$ or above in FIG. 6. This successfully obviates the creasing and cracking of the surface layer 8*a* ascribable to a short tensile strength. In addition, the surface layer 8*a* resists friction acting between it and, e.g., the developing roller 7 and suffers from a minimum of mechanical damage ascribable thereto, exhibiting the expected function over a long period of time.

While the illustrative embodiments have concentrated on the doctor roller 8, the present invention is practicable with an endless belt or similar regulating member so long as it performs endless movement. Further, the present invention is practicable even with a regulating member that does not perform endless movement, e.g., one having a semicircular cross-section and capable of moving its curved surface back and forth. The crux is that the regulating member be capable of moving back and forth to such an extent that removes impurities caught at the regulating position.

In summary, it will be seen that the present invention provides a developing device for an image forming apparatus having various unprecedented advantages, as enumerated below.

(1) The developing device reduces irregular development ascribable to impurities caught at a regulating position more than a conventional developing device using a doctor blade as a regulating member.

(2) The developing device obviates irregular development in the form of fine stripes ascribable to stripe-like irregularities formed in a developer layer existing on a developer carrier. In addition, when use is made of a developer consisting of toner and an additive covering the toner, there can be obviated a wasteful cost otherwise needed to control the surface roughness Rz of the regulating member to less than 1.2 μm.

(3) Images with relatively high resolution are surely achievable.

(4) The oscillation of the developer carrier ascribable to friction acting between it and the regulating member is reduced to allow the developer layer on the developer carrier to have a uniform thickness. This reduces irregular development ascribable to the oscillation.

(5) Irregular development can be obviated even if the regulating member has shape errors.

(6) The surface layer of the regulating member is free from creases even in 200 hours of operation.

(7) The regulating member has its durable time prevented from decreasing due to cracking or peeling. At the same time, close adhesion of the surface layer and a core or under layer also included in the regulating member is insured (8) The surface layer is free from creases and cracks ascribable to the short tensile strength thereof.

(9) There can be obviated irregular development ascribable to the seam of the surface layer.

(10) The tension of the surface layer prevents the surface layer from coming off from the under layer while allowing a minimum of creasing to occur in the surface layer.

Various modifications will become possible for those skilled in the art after receiving the teachings of the present disclosure without departing from the scope thereof.

What is claimed is:

1. A developing device for an image forming apparatus, comprising:

a developer carrier performing an endless movement while carrying a developer containing toner and an additive covering said toner thereon; and a regulating member for regulating a thickness of the developer deposited on said developer carrier in a form of a layer;

wherein the additive of the developer has a particle size of less than 2 μm while said regulating member has a surface roughness Rz greater than or equal to said particle size, but smaller than 2 μm.

2. A developing device as claimed in claim 1, wherein the developer comprises either one of toner having a volume mean particle size of 5 μm or above, but 9 μm or below, and a developer containing said toner.

3. A developing device as claimed in claim 2, wherein said regulating member is formed of a material having an Ascar C hardness of 80 degrees or below.

4. A developing device as claimed in claim 2, wherein a sum of an Ascar C hardness of said developer carrier and an Ascar C hardness of said regulating member is 60 degrees or above.

5. A developing device as claimed in claim 4, wherein said regulating member is formed of a material having an Ascar C hardness of 80 degrees or below.

6. A developing device as claimed in claim 1, wherein a sum of an Ascar C hardness of said developer carrier and an Ascar C hardness of said regulating member is 60 degrees or above.

7. A developing device as claimed in claim 6, wherein said regulating member is formed of a material having an Ascar C hardness of 80 degrees or below.

8. A developing device as claimed in claim 1, wherein said regulating member is formed of a material having an Ascar C hardness of 80 degrees or below.

9. A developing device for an image forming apparatus, comprising:

a developer carrier performing an endless movement while carrying a developer containing toner and an additive covering said toner thereon; and a regulating member for regulating a thickness of the developer deposited on said developer carrier in a form of a layer;

wherein said regulating member has a surface roughness Rz of 1.2 $\mu$m or above, but smaller than 2 $\mu$m.

10. A developing device as claimed in claim 9, wherein the developer comprises either one of toner having a volume mean particle size of 5 $\mu$m or above, but 9 $\mu$m or below, and a developer containing said toner.

11. A developing device as claimed in claim 10, wherein said regulating member is formed of a material having an Ascar C hardness of 80 degrees or below.

12. A developing device as claimed in claim 10, wherein a sum of an Ascar C hardness of said developer carrier and an Ascar C hardness of said regulating member is 60 degrees or above.

13. A developing device as claimed in claim 12, wherein said regulating member is formed of a material having an Ascar C hardness of 80 degrees or below.

14. A developing device as claimed in claim 9, wherein a sum of an Ascar C hardness of said developer carrier and an Ascar C hardness of said regulating member is 60 degrees or above.

15. A developing device as claimed in claim 14, wherein said regulating member is formed of a material having an Ascar C hardness of 80 degrees or below.

16. A developing device as claimed in claim 9, wherein said regulating member is formed of a material having an Ascar C hardness of 80 degrees or below.

17. A developing device for an image forming apparatus, comprising:

a developer carrier performing an endless movement while carrying a developer containing toner and an additive covering said toner thereon; and a regulating member for regulating a thickness of the developer deposited on said developer carrier in a form of a layer;

wherein said regulating member includes a surface layer having a tensile elongation ratio of 150% or above and an under layer having an Ascar C hardness of 90 degrees or below.

18. A developing device as claimed in claim 17, wherein said surface layer is formed of rubber or elastomer resin having a tensile elongation ratio of 1,000% or below.

19. A developing device as claimed in claim 18, wherein said surface layer is 0.03 mm to 3 mm thick.

20. A developing device as claimed in claim 19, wherein said surface layer is seamless.

21. A developing device as claimed in claim 20, wherein said surface layer, which is endless and has an inside diameter smaller than an outside diameter of said under layer, is attached to said under layer in such a manner as to cover a circumferential surface of said under layer.

22. A developing device as claimed in claim 18, wherein said surface layer has a tensile strength of 0.005 G N/m2 or above where G denotes gravitational acceleration.

23. A developing device as claimed in claim 18, wherein said surface layer is seamless.

24. A developing device as claimed in claim 23, wherein said surface layer, which is endless and has an inside diameter smaller than an outside diameter of said under layer, is attached to said under layer in such a manner as to cover a circumferential surface of said under layer.

25. A developing device as claimed in claim 17, wherein said surface layer is formed of resin having a tensile elongation ratio of 600% or below.

26. A developing device as claimed in claim 25, wherein said surface layer is 15 $\mu$m to 150 $\mu$m thick.

27. A developing device as claimed in claim 26, wherein said surface layer is seamless.

28. A developing device as claimed in claim 27, wherein said surface layer, which is endless and has an inside diameter smaller than an outside diameter of said under layer, is attached to said under layer in such a manner as to cover a circumferential surface of said under layer.

29. A developing device as claimed in claim 25, wherein said surface layer is seamless.

30. A developing device as claimed in claim 29, wherein said surface layer, which is endless and has an inside diameter smaller than an outside diameter of said underlayer, is attached to said under layer in such a manner as to cover a circumferential surface of said under layer.

31. A developing device as claimed in claim 17, wherein said surface layer is seamless.

32. A developing device as claimed in claim 31, wherein said surface layer, which is endless and has an inside diameter smaller than an outside diameter of said under layer, is attached to said under layer in such a manner as to cover a circumferential surface of said under layer.

* * * * *